United States Patent [19]

Willums

[11] 4,030,216

[45] June 21, 1977

[54] METHOD OF AND APPARATUS FOR UNDERWATER HYDRAULIC CONVEYING, AS FOR OCEAN MINING AND THE LIKE, AND CONTINUED TRANSPORT OF MATERIAL IN CONTROLLED FLOATING CONTAINERS

[75] Inventor: Jan-Olaf Willums, Sandvika, Norway

[73] Assignee: Nor-Am Resources Technology Inc., Boston, Mass.

[22] Filed: Oct. 28, 1975

[21] Appl. No.: 626,492

[52] U.S. Cl. ..... 37/58; 37/195; 37/DIG. 8; 214/13; 299/8; 302/15

[51] Int. Cl.[2] ..... E02F 3/88

[58] Field of Search ..... 214/12, 15 B, 15 R, 214/15 Z, 13; 299/8; 37/58, DIG. 8, 195; 302/14, 15, 16, 58

[56] References Cited

UNITED STATES PATENTS

| | | | |
|---|---|---|---|
| 3,260,004 | 7/1966 | Brooks | 37/DIG. 8 |
| 3,314,174 | 4/1967 | Haggard | 37/54 |
| 3,343,877 | 9/1967 | Oster | 299/9 |
| 3,438,142 | 4/1969 | Krutein | 37/58 X |
| 3,693,272 | 9/1972 | Gariel | 37/63 |
| 3,753,303 | 8/1973 | Holzenberger et al. | 37/58 |
| 3,783,535 | 1/1974 | Hanks | 37/55 |
| 3,783,536 | 1/1974 | Hanks | 37/55 |
| 3,815,267 | 6/1974 | Laarman | 37/58 |

*Primary Examiner*—L. J. Paperner
*Assistant Examiner*—George F. Abraham
*Attorney, Agent, or Firm*—Shapiro and Shapiro

[57] ABSTRACT

This disclosure is concerned with the hydraulic lifting or conveying of fluids and any bodies carried therewith, such as solid minerals in ocean mining and the like, from depths far greater than the maximum suction heights of pumps and the like, by a partially gas-filled submerged chamber suspended from a stable surface platform and connected to the open environment by means of pipes connected to a buoy, equipped with pumps, and connected to pipes of smaller cross-section extending to the required depth, with the fluid level in the submerged chamber so deep under the ocean surface that the pressure difference between the inside of the chamber and the surrounding water is greater than the pressure drop caused by the transport of fluid and solid material through the pipe from its lower end to the chamber, and with the materials subsequently transported in nearly neutrally buoyant containers, guided by a paravane.

17 Claims, 5 Drawing Figures

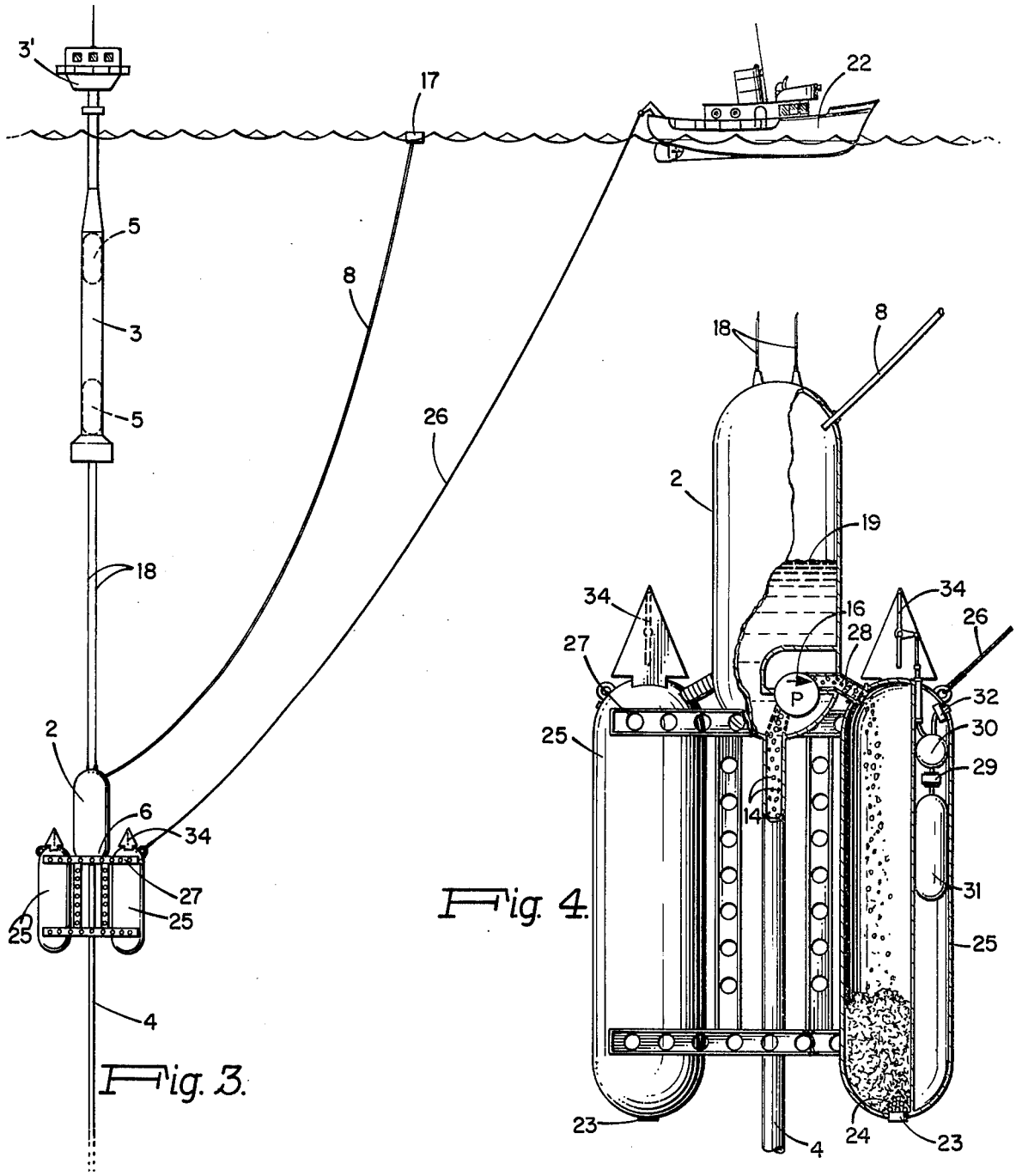
Fig. 3.
Fig. 4.
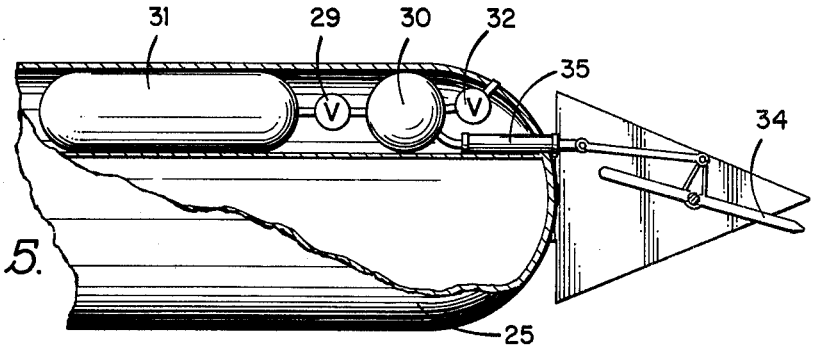
Fig. 5.

METHOD OF AND APPARATUS FOR UNDERWATER HYDRAULIC CONVEYING, AS FOR OCEAN MINING AND THE LIKE, AND CONTINUED TRANSPORT OF MATERIAL IN CONTROLLED FLOATING CONTAINERS

The present invention is concerned with methods of and apparatus for continuous underwater hydraulic conveying and ocean transport, being more particularly concerned with a method of lifting materials from the ocean bottom and transporting them to land. Various types of hydraulic and other conveying and recovery systems have been proposed and used over the years to mine minerals and other objects or otherwise recover material from under the sea or other bodies. Several typical pumping and related apparatus of this character are described, for example in U.S. Pat. Nos. 2,992,497; 3,111,778; 3,143,816; 3,237,562; 3,248,812; 3,260,004; 3,305,950; 3,314,174; 3,333,562; and 3,343,877.

Most hydraulic systems proposed for ocean mining, including those of the above-entitled patents, however, require highly complex mechanisms for inducing an upward water flow. They rely, for example, on expanding air which is injected under extremely high pressures between the bottom unit of the pipe and the surface vessel, or by injecting water in a similar fashion, or by installing pumps or other devices at the lower end of the pipe or along the pipe connecting the bottom area with the surface vessel. These techniques result in unreliable systems, as control and service of installations under several hundred atmospheres of pressure, as would be required for deep ocean mining, is most difficult. In addition, the stability of the surface vessel has been a limiting factor for operation in bad weather, and the mostly fixed design of such prior art systems makes it very difficult if not impossible to adapt the same to various water depths.

In accordance with the present invention, on the other hand, these limitations have become obviated, in summary, by a method and apparatus, wherein a fluid receiving and conveying chamber, suspended from a stable surface platform and adjustable in depth, is connected by pipes to a surface buoy for maintaining direct access to the atmospheric environment, but with a fluid level in the chamber maintained low enough so that the pressure difference between the inside of the chamber and the surrounding fluid is sufficient to lift the water and material from the ocean bottom to the chamber, and with adaptability for subsequent transport of the material in nearby neutrally buoyant containers. Preferred details are hereinafter set forth.

An object of the present invention, accordingly is to provide a new and improved and highly adaptable method of and apparatus for underwater hydraulic conveying and subsequent transport, as for ocean mining and the like, as well as similar purposes, that shall not be subject to the limitations and difficulties described above.

A further objective is to provide such a novel method and apparatus of more general utility, as well; other and further objects being explained hereinafter and being more particularly delineated in the appended claims.

The invention will now be described with reference to the accompanying drawing,

FIG. 1 of which is a side elevation of an illustrative pumping system;

FIG. 3 is an alternative system for storage and transport of the mined materials;

FIG. 4 is a fragmentary section of the system shown in FIG. 3, illustrating preferred details of the transport system; and FIG. 5 is a similar view of neutral buoyant transport of the mined materials.

Figure 1:
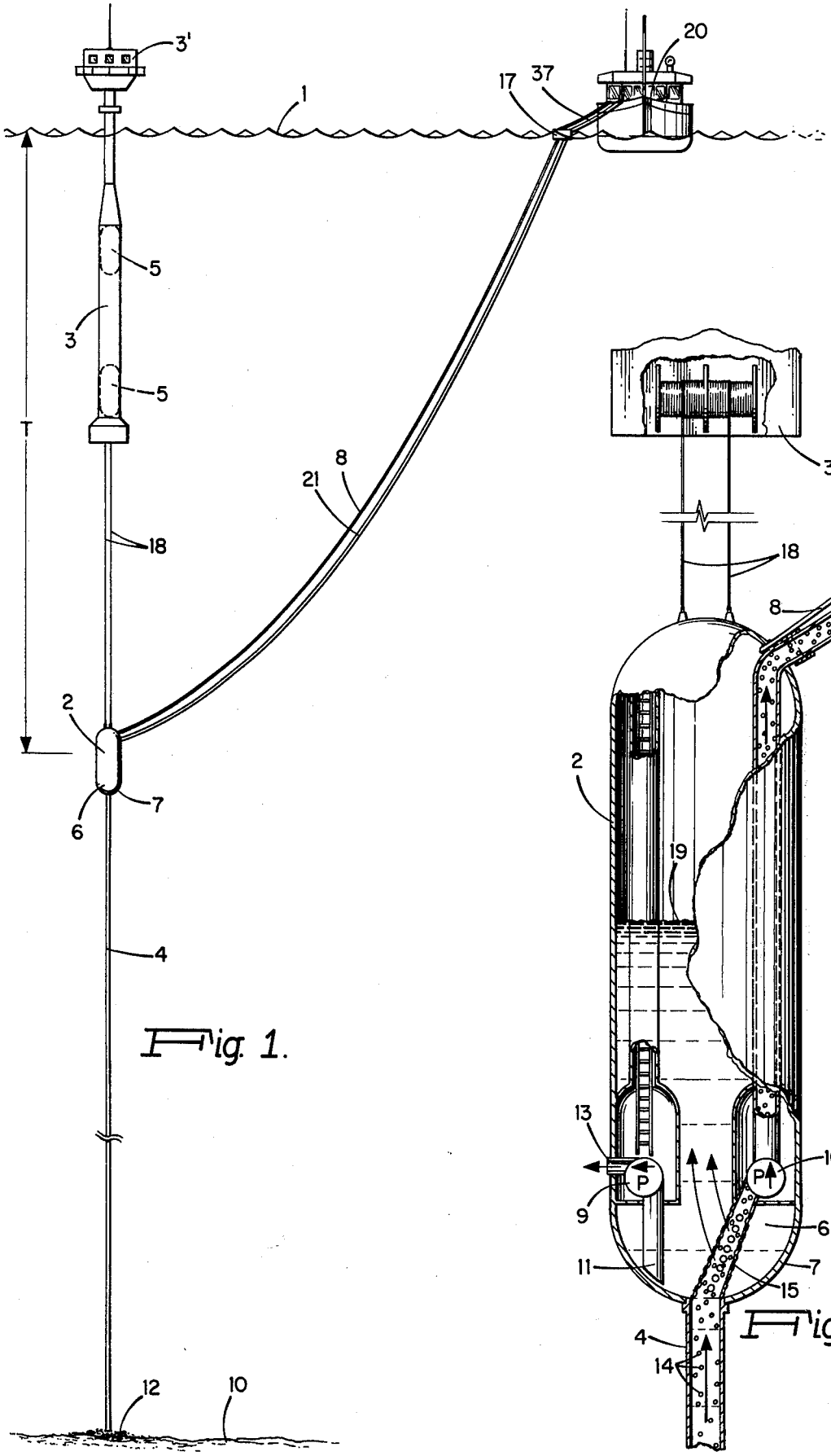
Figure 2:
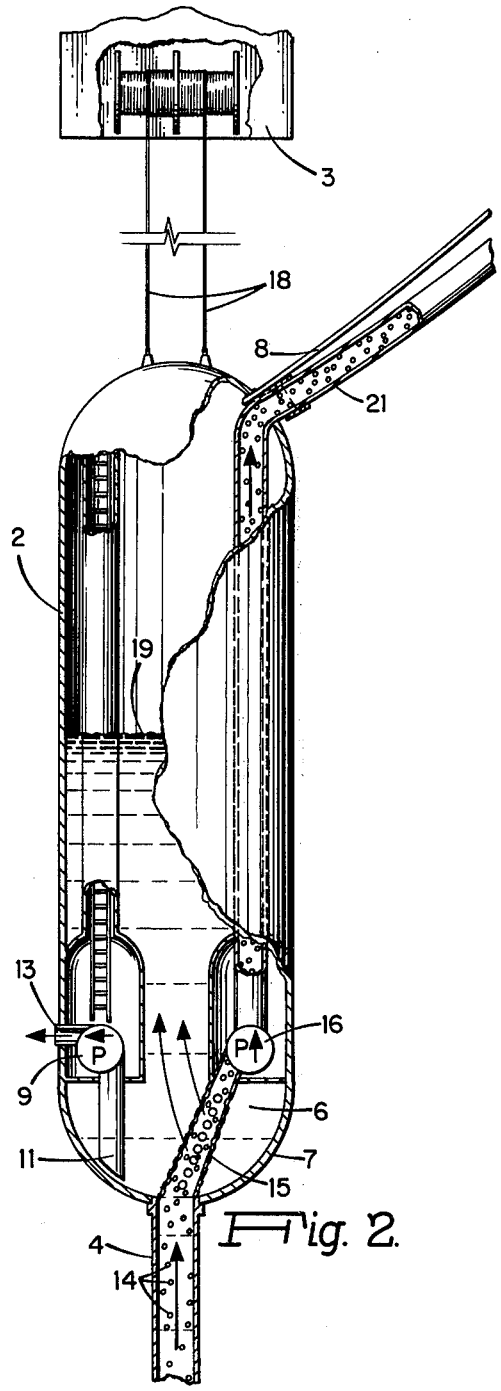
FIG. 2 is a fragmentary longitudinal section of the system, illustrating preferred details of the conveying or lifting of solid particles from the ocean bottom in accordance with the method underlying the present invention.

Referring to FIGS. 1 and 2, a pumping chamber 2 is shown attached to a surface station platform 3, which is carrying ballast tanks or similar elements 5 for enabling the bringing of the station 3 from a transport position, by ballast flooding, to its substantially vertical or upright working position, shown, with an above-the-surface platform 3′ exposed above the ocean surface, maintained stable and practically unaffected by wave movements, winds and the like, because of its inherently low center of gravity and small cross-sectional area. The ballast tanks 5 will also assist in controlling the draft of the platform under operation. Details of such mechanisms are known, as described, for example, in "Ocean Engineering", edited by J. F. Brahtz, John Wiley & Sons, Inc., New York, 1968, and need not be further elaborated here.

It will be observed that there has been extended from the lower terminal chamber portion 6 of the pumping chamber 2 a substantially smaller cross-section fluid-receiving-and-conveying conduit, transport tube, or similar pipe-like device 4 that, as more particularly shown in FIG. 2, communicates at its open lower end with the region of the ocean bottom 10 at which solid particles 12 or other materials are to be transported upward as at 14, FIG. 2, under suction, later explained, along the conduit 4. The upper end of the conduit 4 opens through the end wall 7 of the chamber terminal portion 6 of the suspended chamber 2 to permit the water fluid and particles 14 carried thereby during the ascending upward along the transport conduit device 4, to enter the larger chamber 6. The partially air or gas-filled chamber 6 is hollow to receive the water fluid and particles, being preferably connected to and communicating with the gaseous atmosphere and its atmospheric pressure by means of an air inlet pipe 8 carried at the surface by a mooring buoy 17 preferably separated and remote from the surface platform 3—3′.

In the chamber 6, there is disposed a pump (or pumps) 9, such as a multi-stage centrifugal pump or the like, or pumps of the type described in said patents, the suction head 11 of which descends to the bottom wall 7 of the chamber 6, providing pressure heads at 13 to pump the fluid 19 from within the chamber 6 out into the surrounding ocean or other fluid.

The operation of the invention is based upon the following critical adjustment and conditions. Through submerging under the ocean surface 1 of the chamber 6, a moving force is created which is proportional to the depth T of submergence, and which forces the water from below, upward through the conveyance conduit 4. By maintaining a deliberate difference between the level of the ocean surface 1 and the level of the fluid 19 in the chamber 6, a continuous flow of water will be produced through conduit 4. The level at 19 is thus controlled by the pump (or pumps) 9 within the chamber 6, which, after separating the majority of the water from the water-material-mix entering the chamber 6 through conduit 4, pumps the water back out at 13 into a submerged region of the ocean.

As a result of the upward movement, or transport of the water in the conduit 4, the solid particles 12 on the bottom 10, close to the open lower inlet end of the conduit 4, will be drawn upwards, also. In the chamber 6, a separation device, shown as a conveying porous filter cone 15, functions as a divider or separator of water and the solid particles, with the latter removable through slurry conduits 21 to the surface buoy 17 by any well-known means, such as, for example, an injection pump 16.

The physical aspects of the operations can be summarised as follows. The transport of the water and solids 14 through the vertical conduit 4 causes a pressure drop that is mainly due to the friction between the flowing water and the pipe and the pressure drop due to the lifting of solid particles from the ocean floor to the surface; the pressure drops caused by the acceleration of water and particles from the velocity zero to the transport velocity and other frictional pressure drops being negligible in comparison, and being overcome by the above-described system. To make the transport possible, however, another condition must be satisfied; namely, the water velocity in the conduit 4 must be larger than the steady state sinking velocity of the particles. Thus, the system can only work if the two conditions are satisfied that (1) a pressure differential between chamber 6 and its surrounding water must be at least equal to the total pressure drop caused by lifting of the solid particles and friction of the fluid, and (2) the fluid velocity in the pipe 4 must be larger than the steady state sinking velocity of the particles. These conditions are described in my British Pat. No. 1,396,369.

Submerging the chamber 6, while connected to the surface environment by pipes 8 and 21, thus results in a pressure around the chamber proportional to the submerging depth T. There exists, thus, a pressure differential equivalent to waterdepth T, which will result in a flow of water and solids through conduit 4 into chamber 6. After the separation of liquid and solids near the bottom 7 of the chamber 6, the water is exhausted or removed from the chamber against the pressure existing outside the chamber, and the material 14 is conveyed under the action of the injection pumps 16 to the buoy 17 at the surface 1.

Since the pump (or pumps) 9 is contained in a chamber maintained at substantially atmospheric pressure conditions there is always free accessibility. In addition, this operation involves only pumping of water without solids, with the solids removed by any well-known mechanical conveyance or transport, such as the before-described slurry or injection pump 16. The pump 9 functions in such a way that the level of the water 19 in the chamber 6 remains constant, and the pressure required for the flow is maintained. Adjustment of the pressure differential can easily be achieved by adjusting the depth or submergence of the chamber 6. This is readily effectable by varying the length of the connection between chamber 6 and the surface station 3 as by cables 18 which can be adjusted in length from the surface platform 3—3'.

At the end of the conduit 4 on the ocean floor 10, a special solids-pick-up-system may also be employed as described, for example, in the before-cited patents; and the whole recovery system may be moved in the horizontal plane over the bottom, if desired, as is well known.

The material 14 is conveyed by conventional means from the pumping chamber 6 to the surface buoy 17, where a transport vessel 20 may load the material through a further conveying system 37. As the transport vessel 20 is attached to the buoy 17 and not to the surface vessel 3—3', loading can be done even in heavy seas, and no collision hazard between transport vessel 20 and surface station 3 exists. By providing for several pipes 21 and remote buoys 17, moreover, several transport vessels 20 can be filled simultaneously, and continuous operation can be guaranteed.

Thus the invention enables recovery from extreme depths, very many times the depth of submergence of the chamber, and with practical-size pumping apparatus, and operating under most kinds of weather conditions. Very economical lifting of minerals or other bodies from the ocean floor is thus attainable. As the submerging depth of the pumping chamber can be adjusted to any desired depth, the system is very versatile and adaptable to any ocean environment. In addition, the system is easy to transport and economical to build, as only few major elements must be constructed. More generally, these advantages may be beneficially used in other applications than ocean mining and the like, including, for example, other fluid systems as in chemical fluid processing. While the invention has been described in connection with the preferred atmosphere-connected chamber 6, moreover, other operations may permit the employment of a predetermined gas pressure, as in a fluid separation device connected to chamber 6. In some applications, moreover, the fluid difference pressure may be obtained by evaporation or similar techniques other than pumping, thus to produce the required force for conveying the fluid upward along the conduit 4.

In another aspect of the invention, the storage of mined material 14 may take place in removable chambers 25 which are detachably positioned adjacent and around the submerged pumping chamber 2–6, as shown in FIG. 3 and in more detail in FIG. 4. These units 25 may be applied and detached, as later explained, and towed away and replaced with new containers by transport vessels 22, such as tugboats or submarines. When in the filling position of FIGS. 3 and 4, the containers 25 are detachably connected to the pumping chamber 2 by a mount 27. The material 14 is pumped into the containers 25 through feeding pipes 28 similar to, but shorter than, the surface conveyers 21 of FIG. 1. The one-way valves 23 at the lower end of the containers 25 will thereby be open as to allow the water to flow out to the ocean environment, with a grid or filter 24 preventing the solid material from escaping.

Referring further to FIG. 4, the subsequent transport mechanism will now be explained. When the containers 25 are filled to a predetermined degree, air is pumped into the chambers so as to remove the water from the container through valve 23, as later explained. Each container becomes thereby close to neutral buoyancy, and can be easily transported to land, either by tugboat or transport submarine 22. In order to improve the handling of the containers 25, they are preferably equipped with paravanes 34, as, for example, of the type described in "Ocean Industry", December 1971, page 25, Gulf Publishing Company, and more particularly detailed in FIG. 5 herein. The paravane system is improved by a compressed air system in which the compressed air is pumped from a container 31, FIG. 5, previously filled during the filling operation of container 25.

While FIG. 4 illustrates the containers 25 in the substantially vertical storing position, FIG. 5 shows part of the container in a substantially horizontal transport position being remotely controlled via cables 26 from the tug vessel 22. When valve 29 is opened in the paravane, increasing the pressure in a control chamber 30, the rudder 34 is forced by a piston 35 to a position guiding the whole container 25 into deeper water, until the pressure on the rudder (which is the sum of the hydrostatic pressure and the rudder pressure), equals the pressure in the control chamber 30. Similarly, the pressure in the control chamber 30 may be decreased by a release valve 32, thus guiding the container upwards. The same system can be applied for control of the movements in the horizontal plane. Air can be released into the container 25 from the same air container 31 through the control valve, which allows control of the pressure and buoyancy in the main container 25. By this double-control system, which is remotely controlled by the cables 26 in well-known fashion from the tug or transport submarine 22, the desired position and depth of the containers 25 can always be maintained. An additional paravane (not shown) may also be attached to the back end of containers 25 for improved control.

As several containers may be placed around the pumping chamber 2–6, a continuous process of filling can be obtained, as there can always be an empty container available for filling. Even if extremely heavy seas and stormy weather might delay the arrival of a tugboat, the mining operation can still continue, as the material may be stored in the containers and await being picked up without hampering the mining operations, particularly in view of the fact that these containers can be made neutrally buoyant as before explained. The operation is very efficient, as no ship has to wait either at the mining site to be filled or at the land terminal for being emptied, and the containers can serve as storage units while the material is awaiting processing on land.

Other improvements of this concept and the proper selection of design and material will be readily discernable to those skilled in the art of ocean engineering and naval architecture and such are considered to fall within the spirit and scope of the invention. The invention, moreover, is not limited to ocean mining alone, but can be applied to other similar transportation problems in the ocean and elsewhere, as well.

What is claimed is:

1. A method of hydraulically lifting and conveying materials carried by fluids from underwater depths, that comprises, suspending a partially gas-filled pumping chamber by cable means from a stable surface platform and submerging said chamber in said fluid spaced from the bottom thereof; maintaining the pumping chamber at a pressure equal to the atmospheric pressure at the surface region of said fluid; communicating the lower end of the submerged chamber through a fluid-receiving-and-conveying conduit of smaller cross-section than the chamber to greater depths, including depths many times the depth of submergence of the chamber, from which materials are to be hydraulically lifted with the fluid along the conduit and into the chamber; adjusting the fluid level of the submerged chamber to a depth such that the pressure difference between the inside of the chamber and the surrounding fluid is sufficient to lift the fluid and materials through the conduit; separating the materials from the fluid; exhausting the fluid outside the chamber; and conveying the separated materials to a surface region of said fluid remote from said platform.

2. A method as claimed in claim 1 and in which the separated materials within the chamber are conveyed directly to the said surface region remote from said platform.

3. A method as claimed in claim 1 in which said conveying comprises transferring the materials within the chamber into a container positioned adjacent said chamber, maintaining said container in a nearly neutral buoyancy condition, remotely detaching said container from its position adjacent said chamber, and guiding the same upward to the surface.

4. A method as claimed in claim 3 and in which the separating of the fluid and materials lifted into the chamber is effected within said container.

5. A method as claimed in claim 3 and in which said container is positioned substantially vertically adjacent said chamber, and said guiding comprises controlling the buoyancy therein to orient the detached container to a substantially horizontal transport position.

6. Apparatus for hydraulically lifting and conveying materials carried by fluids from underwater depths, having, in combination, a stable surface platform, a partially gas-filled pumping chamber suspended by cable means from and maintained submerged beneath said platform and above the bottom of the fluid; conduit means for maintaining the pumping chamber at a pressure equal to the atmospheric pressure at the fluid surface; fluid-receiving-and-conveying conduit means connected from the lower end of said chamber to greater depths, including depths many times the depth of submergence of the chamber, for enabling materials to be hydraulically pumped and lifted with the fluid along the last-named conduit means and into the said chamber; means for adjusting the fluid level of the said submerged chamber to a depth such that the pressure difference between the inside of the chamber and the surrounding fluid is sufficient to lift the fluid and materials through the conduit; means for separating said lifted materials from the fluid; means for exhausting the separated fluid outside the chamber; and means for conveying the separated materials to a surface region remote from said platform.

7. Apparatus as claimed in claim 6 and in which said conveying means is provided directly between said chamber and floating means disposed at the fluid surface at a region remote from said platform, for conveying the separated materials to said surface region remote from said platform.

8. Apparatus as claimed in claim 6 and in which there is provided container means detachably positioned adjacent said submerged chamber, said conveying means comprising means for transferring materials within said chamber into said container means, means for maintaining said container means in a nearly neutral buoyancy condition, means for remotely detaching said container means from the position adjacent said submerged chamber, and means for thereupon guiding the same upward to the surface.

9. Apparatus as claimed in claim 8 and in which means is provided for separating the said fluid and materials that were lifted into the chamber, within said container means.

10. Apparatus as claimed in claim 8 and in which there is provided means for positioning the said container means substantially vertically adjacent said chamber, and said guiding means comprises means for controlling the buoyancy within the container means to orient the detached container means to a substantially horizontal transport position.

11. A method as claimed in claim 3, wherein said guiding comprises transporting said container by boat.

12. A method as claimed in claim 1, wherein said adjusting step comprises adjusting the length of said cable means.

13. A method of hydraulically lifting and conveying materials carried by fluids from underwater depths, that comprises, submerging a partially gas-filled pumping chamber from a stable surface platform; maintaining the pumping chamber at a pressure equal to the atmospheric pressure at a surface region remote from said platform; communicating the lower end of the submerged chamber through a fluid-receiving-and-conveying conduit of smaller cross-section than the chamber to greater depths, including depths many times the depth of submergence of the chamber, from which materials are to be hydraulically lifted with the fluid along the conduit and into the chamber; adjusting the fluid level of the submerged chamber to a depth such that the pressure difference between the inside of the chamber and the surrounding fluid is sufficient to lift the fluid and materials through the conduit; separating the materials from the fluid; conveying the materials within the chamber into a container positioned adjacent said chamber, maintaining said container in a nearly neutral buoyancy condition, remotely detaching said container from its position adjacent said chamber, and guiding the same upward to the surface.

14. Apparatus as claimed in claim 8, wherein said guiding means comprises boat means for transporting said container means.

15. Apparatus as claimed in claim 8, wherein said exhausting means comprises first pump means and said transferring means comprises second pump means operating concurrently with said first pump means for transferring into said container means fluid carrying said materials while that fluid is being moved in response to the operation of said first pump means.

16. Apparatus as claimed in claim 6, wherein said adjusting means comprises means for adjusting the length of said cable means.

17. Apparatus for hydraulically lifting and conveying materials carried by fluids from underwater depths, having, in combination, a stable surface platform; a partially gas-filled pumping chamber connected with and maintained submerged beneath said platform; floating means disposed at the fluid surface at a region remote from said platform; conduit means extending between said floating means and said pumping chamber for maintaining the pumping chamber at a pressure equal to the atmospheric pressure at said floating means; fluid-receiving-and-conveying conduit means connected from the lower end of said chamber to greater depths, including depths many times the depth of submergence of the chamber, for enabling materials to be hydraulically pumped and lifted with the fluid along the last-named conduit means and into the said chamber; means for adjusting the fluid level of the said submerged chamber to a depth such that the pressure difference between the inside of the chamber and the surrounding fluid is sufficient to lift the fluid and materials through the conduit; means for separating said lifted materials from the fluid; container means detachably positioned adjacent said submerged chamber, means for conveying materials within said chamber into said container means, means for maintaining said container means in a nearly neutral buoyancy condition, means for remotely detaching said container means from the position adjacent said submerged chamber, and means for thereupon guiding the same upward to the surface.

* * * * *